US006342084B1

(12) United States Patent
Pezzaniti

(10) Patent No.: US 6,342,084 B1
(45) Date of Patent: Jan. 29, 2002

(54) VACUUM CLEANER

(75) Inventor: Mario Pezzaniti, Balcatta (AU)

(73) Assignee: Fantovac Industries PTY LTD, Balcatta (AU)

( * ) Notice: Subject to any disclaimer, the term of this patent is extended or adjusted under 35 U.S.C. 154(b) by 0 days.

(21) Appl. No.: 09/485,011

(22) PCT Filed: Jul. 29, 1998

(86) PCT No.: PCT/AU98/00598

§ 371 Date: Jan. 28, 2000

§ 102(e) Date: Jan. 28, 2000

(87) PCT Pub. No.: WO99/05954

PCT Pub. Date: Feb. 11, 1999

(30) Foreign Application Priority Data

Jul. 31, 1997 (AU) ..... P08309

(51) Int. Cl.[7] ..... B01D 46/02

(52) U.S. Cl. ..... 55/361; 55/363; 55/368; 55/379; 55/380; 55/DIG. 3; 15/347; 15/349

(58) Field of Search ..... 255/379, 380, 255/471, 263, 378, DIG. 2, DIG. 3; D15/347, 349; D55/361, 364, 365, 368

(56) References Cited

U.S. PATENT DOCUMENTS

| | | | | | |
|---|---|---|---|---|---|
| 2,022,249 | A | * | 11/1935 | Lofgren | 55/DIG. 3 |
| 2,766,842 | A | * | 10/1956 | Hurd | 55/DIG. 3 |
| 2,771,151 | A | * | 11/1956 | Osborn | 55/DIG. 3 |
| 2,848,063 | A | | 8/1958 | Meyerhoefer | |
| 3,343,344 | A | | 9/1967 | Fairaizl et al. | |
| 3,653,189 | A | * | 4/1972 | Miyake et al. | 55/DIG. 3 |
| 5,273,561 | A | * | 12/1993 | Zeren | 55/DIG. 3 |
| 5,498,272 | A | * | 3/1996 | Leon | 55/DIG. 3 |
| 5,914,416 | A | * | 6/1999 | Thode | 55/DIG. 3 |
| 5,961,677 | A | * | 10/1999 | Scott | 55/DIG. 3 |
| 6,083,292 | A | * | 7/2000 | Fumagalli | 55/DIG. 3 |

FOREIGN PATENT DOCUMENTS

| | | |
|---|---|---|
| EP | 91119658.2 | 11/1991 |
| GB | 276545 | 9/1927 |
| GB | 670219 | 4/1952 |

OTHER PUBLICATIONS

EP–557096 A1, Aug. 25, 1993, Patent Abstract.
US4527302, Jul. 9, 1985, Essex, JD, et al., Patent Abstract.
DE2854245 A, Jun. 21, 1979, Patent Abstract.
JP08154875 A, Jun. 18, 1996, Patent Abstract.
DE29520162 U1, Jul. 18, 1996, Patent Abstract.
US5524329, Jun. 11, 1996, Schmalzel D, Patent Abstract.
DE4439761 A1, May 9, 1996, Patent Abstract.
US5080697, Jan. 14, 1992, Finke, E.W., Patent Abstract.
DE3404080 A, Aug. 8, 1995, Patent Abstract.
DE3017234 A, Nov. 13, 1980, Patent Abstract.
EP–812562 A2, Dec. 17, 1997, Patent Abstract.
DE19606146 A1, Aug. 21, 1997, Patent Abstract.

(List continued on next page.)

*Primary Examiner*—David A. Simmons
*Assistant Examiner*—Minh-Chau T. Pham
(74) *Attorney, Agent, or Firm*—Christie, Parker & Hale, LLP

(57) ABSTRACT

A vacuum cleaner apparatus (10) is provided which includes a vacuum motor (16), an air pervious membrane (26) and an air pervious material collection bag (22). The vacuum motor (16) is arranged to draw air downwardly in turn through the bag (22), the membrane (26) and the motor (16) so that, in use, the bag (22) retains material entrained in the air. There is also provided a spacing means (28) located intermediate the membrane (26) and the bag (22) for orienting the bag such that a first portion (35) of the bag is adjacent the membrane and a second portion (32) of the bag is spaced from the membrane.

9 Claims, 2 Drawing Sheets

OTHER PUBLICATIONS

NL1001393 C2, Apr. 15, 1997, Patent Abstract.
US5349721, Sep. 27, 1994, Iida Y., Patent Abstract.
EP–602007 A2, Jun. 15, 1994, Patent Abstract.
FR2686010 A1, Jul. 16, 1993, Patent Abstract.
SU1655459 A, Jun. 15, 1991, Patent Abstract.
EP–385298 A, Sep. 5, 1990, Patent Abstract, 2 pages.
SU1398815 A, May 30, 1988, Patent Abstract.
FR2611481 A, Sep. 9, 1988, Patent Abstract.
WO8602817 A, May 55, 1986, Patent Abstract, 6 pages.
GB2151704 A, Jul. 24, 1985, Patent Abstract.
US4226575, Oct. 7, 1980, Hyatt, R.L., Patent Abstract.
SU–548261 A, Apr. 7, 1977, Patent Abstract.
SU–520098 A, Aug. 16, 1976, Patent Abstract.
RO–61263 A, Jul. 31, 1976, Patent Abstract.
FR2746289A1, Sep. 26, 1997, Patent Abstract.
Results of Prior Art Search, pp. 1–22.

* cited by examiner

VACUUM CLEANER

BACKGROUND OF THE INVENTION

1. Field of the Invention

The present invention relates to a vacuum cleaner.

2. Description of the Related Art

Vacuum cleaners typically include a vacuum motor and an air pervious bag for collecting material such as dust and other small particulate material. The vacuum motor induces an air flow through the bag and entrained material is collected in the bag. With known vacuum cleaners it is found that when the vacuum cleaner is new the degree of air flow generated through the bag by means of the vacuum motor is good and collection of material is achieved efficiently.

The efficiency of collection of material may be sustained if the vacuum cleaner is maintained regularly. However, it is often the case that vacuum cleaners are not maintained properly and this can then cause a build up of accumulated material in the bag. In this case the air flow is gradually reduced and thus the efficiency of collection of material is correspondingly reduced.

Furthermore, the reduced air flow leads to reduction of the cooling effect of the air on the vacuum motor.

In a backpack type vacuum cleaner, the orientation, in use, of the vacuum cleaner is such that a vacuum motor locates below a collection chamber, the collection chamber being provided with an air pervious collection bag. In operation, the motor creates a suction force which acts to draw air from an inlet located above the bag through the bag and the motor to an outlet located below the motor. With this configuration, as the bag fills with dust or particulate material, holes in the bag become blocked and the resistance to air flow caused by the bag is increased. As a result, over time, the more the vacuum cleaner is used, the lower the suction force of the vacuum cleaner and the lower the cooling effect of the air flow on the motor.

The present invention provides an apparatus which seeks, among other things, to alleviate the above mentioned problems.

BRIEF SUMMARY OF THE INVENTION

In accordance with one aspect of the present invention there is provided a vacuum cleaner apparatus which includes a vacuum motor, an air pervious membrane and an air pervious material collection bag, the vacuum motor being arranged to draw air downwardly in turn through the bag, the said membrane, and the motor so that, in use, the bag retains material entrained in the air, wherein there is also provided a spacing means located intermediate the said membrane and the bag for orienting the bag such that a first portion of the bag is adjacent the said membrane and a second portion of the bag is spaced from the said membrane.

BRIEF DESCRIPTION OF THE SEVERAL VIEWS OF THE DRAWINGS

The present invention will now be described, by way of example, with reference to the accompanying drawings in which.

DETAILED DESCRIPTION OF THE INVENTION

Figure 1:
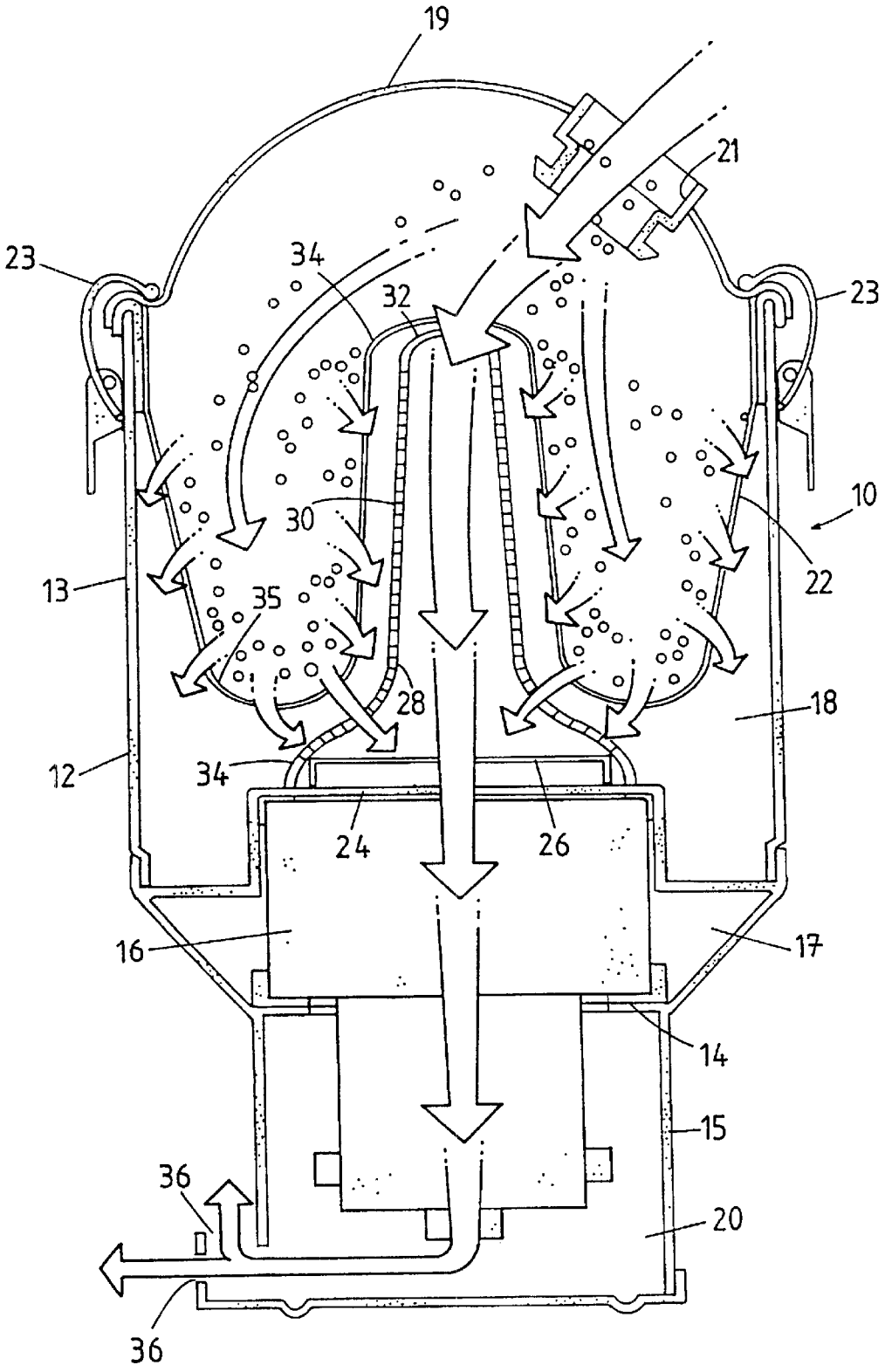
FIG. 1 is a schematic sectional view of a vacuum cleaner in accordance with the present invention.
Figure 2:
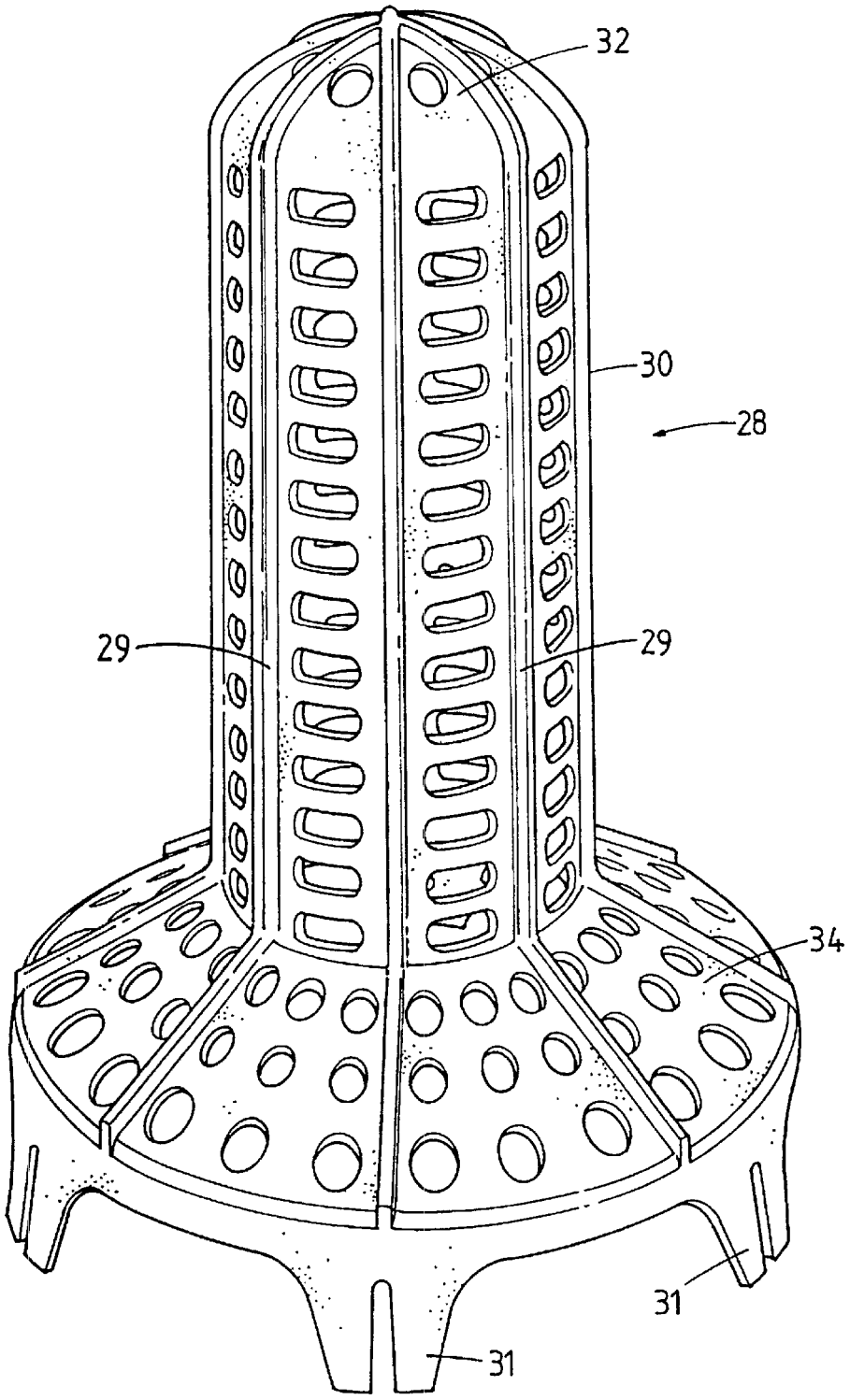
FIG. 2 is a diagrammatic perspective view of a spacing means of the vacuum cleaner shown in FIG. 1.

In the accompanying drawings, there is shown a vacuum cleaner 10 oriented for use, the vacuum cleaner 10 including a housing 12 containing a partition 14. A vacuum motor 16 is mounted adjacent and upwardly of the partition 14. The housing 12 includes a first casing 13 and a second casing 15, the first casing 13 defining an inlet chamber 18 and the second casing 15 defining an intermediate chamber 17 and an outlet chamber 20. Also provided is a lid 19 having an air inlet 21, the lid 19 being fixed to the first casing 13 by releasable fixing means 23.

The inlet chamber 18 contains an air pervious bag 22 arranged to collect dust and other small particulate material, the bag being formed of a material such as nylon or any other filter material which is sufficiently smooth to minimise cling of the dust or particulate material to the bag. The second casing 15 includes a perforated upper wall member 24 which includes an air pervious membrane in the form of a base portion 26.

Further, mounted within the inlet chamber 18 in a central region thereof resting on the base portion 26 is a spacing means in the form of a substantially bell shaped member 28. The bell shaped member 28 includes a perforated elongate substantially frusto-conical wall portion 30, a perforated small end portion 32, and a perforated large end portion 34 of substantially frusto-conical shape, the large end portion 34 being open. The configuration and location of the spacing means is such that the small end portion 32 locates adjacent the air inlet 21.

The frusto-conical wall portion 30 is shaped such that outer and inner surfaces of the wall portion 30 subtend a shallow angle with a central longitudinal axis of the wall portion 30. The frusto-conical large end portion 34 is shaped such that outer and inner surfaces of the large end portion 34 subtend an angle with the central longitudinal axis of the wall portion 30 which is greater than the angle subtended between the outer and inner surfaces of the wall portion and the central longitudinal axis.

The bell shaped member 28 also includes ribs 29 extending longitudinally of an outer surface of the bell shaped member 28, and fixing means 31 for facilitating fixing of the bell shaped member to the base portion 26.

The bag 22 is draped over an upper edge of the first casing 13 as shown in FIG. 1 and then would normally closely conform to the internal shape of the wall member 24 which includes the base portion 26. However, because of the presence of the bell shaped member 28, a central portion 34 of the bag 22 is draped over the bell shaped member 28 so that the central portion 34 is spaced further away from the motor 16 and the base portion 26 than would normally be the case. The central portion 34 is surrounded by an annular peripheral portion 35 which is disposed adjacent to the base portion 26.

Thus, the bag 22 has a larger operative surface area through which air can pass than a normal bag in a conventional vacuum cleaner configuration.

Also, when there is an accumulation of material in the inlet chamber 18, the central portion 34 is generally disposed above the accumulated material. Thus, even when the vacuum cleaner contains a substantial amount of accumulated material, substantially unimpeded air flow is achieved through the central portion 34 and effective cooling of the motor 16 can be maintained.

The outlet chamber 20 contains an exhaust 36.

In the above described embodiment, the spacer member is in the form of a substantially bell shaped member 28. However, it will be appreciated that the spacer member may have any shape which enables it to perform adequately in accordance with the present invention. For example, it may be frusto-conical in shape, parabolical in shape or hemispherical in shape.

The present invention may be applied to any vacuum cleaner but it is particularly envisaged for use with backpack type vacuum cleaners.

In use, the vacuum cleaner 10 is oriented as shown in FIG. 1. The vacuum motor 16 is energised and thus induces an air flow downwardly in turn through the bag 22, the spacer means, the base portion 26 and the motor 16. Material entrained in the air flow is collected in the bag 22 around the central portion 34 thereof in the annular portion 35. Since the central portion 34 locates, in use, generally above the collection material and adjacent the air inlet, even when the bag 22 is full a substantial air flow is still allowed to pass through the central portion 34 such that a relatively high suction force is maintained and cooling of the motor 16 is maintained.

It will be understood that the air flow passing through the vacuum cleaner follows a substantially cyclonic path with the majority of the dust and particulate material being entrained in a peripheral portion of the air flow. As a consequence, by virtue of the configuration and location of the spacer means relative to the air inlet, the dust or particulate material is urged towards the annular portion 35 of the bag and the central portion 34 of the bag is maintained relatively free from dust. It will also be understood that since the bag is formed of relatively smooth material, a majority of dust or particulate material which falls on the bag on and adjacent the central portion falls to the annular portion 35 by virtue of the suction force generated by the vacuum motor and under gravity.

Modifications and variations such as would be apparent to a skilled addressee are deemed to be within the scope of the present invention.

What is claimed is:

1. A vacuum cleaner apparatus comprising a vacuum motor, an air pervious membrane, an apertured spacing means and an air permeable material collection bag, wherein the spacing means extends upwardly from the membrane and is located intermediate the membrane and the bag so as to orient the bag such that a first portion of a lower surface of the bag adjacent the spacing means locates adjacent the membrane and a second portion of the lower surface of the bag in contact with the spacing means is spaced from the membrane and is disposed above the membrane, the vacuum motor being arranged to draw air downwardly in turn through the bag, the spacing means, the membrane and the motor so that the bag retains material entrained in the air.

2. A vacuum cleaner as claimed in claim 1, wherein the spacing means includes an apertured first end portion and an open apertured second end portion, the first end portion being located adjacent an air inlet of the vacuum cleaner, and the second end portion being located adjacent the membrane.

3. A vacuum cleaner as claimed in claim 2, wherein the spacing means is a substantially bell shaped member including an elongate substantially frusto-conical portion intermediate the first end portion and the second end portion, the second end portion being substantially frusto-conical shaped and being of enlarged internal diameter relative to the internal diameter of the frusto-conical portion.

4. A vacuum cleaner as claimed in claim 2, wherein the spacing means is a substantially frusto-conical shaped member, a substantially parabolical shaped member or a substantially hemispherical shaped member.

5. A vacuum cleaner as claimed in claim 1, wherein the vacuum cleaner includes a housing having a first casing defining a collection chamber, and a second casing defining an intermediate chamber and an outlet chamber, a platform being provided at a junction of the intermediate chamber and the outlet chamber and the vacuum motor being accommodated on the platform.

6. A vacuum cleaner as claimed in claim 5, wherein the second casing includes an upper apertured wall and the spacing means locates on the upper apertured wall extending upwardly thereof.

7. A vacuum cleaner as claimed in claim 5, wherein the second casing includes an upper apertured wall and the spacing means locates on the upper apertured wall extending upwardly thereof and wherein the spacing means is located such that an internal portion of the spacing means aligns with an air flow generated by the vacuum motor.

8. A vacuum cleaner as claimed in claim 1, wherein the bag is formed of nylon material.

9. A vacuum cleaner as claimed in claim 1, wherein the vacuum cleaner is a back pack type vacuum cleaner.

* * * * *